US005899003A

United States Patent [19]

Strommen et al.

[11] Patent Number: 5,899,003

[45] Date of Patent: May 4, 1999

[54] METHOD AND APPARATUS FOR DRYING OF MATERIALS CONTAINING VOLATILE COMPONENTS

[75] Inventors: Ingvald Strommen, Ranheim; Kjartan Kramer; Ola Jonassen, both of Bratsberg, all of Norway

[73] Assignee: Sinvent AS, Trondheim, Norway

[21] Appl. No.: 08/513,752

[22] PCT Filed: Mar. 1, 1994

[86] PCT No.: PCT/NO94/00049

§ 371 Date: Oct. 30, 1996

§ 102(e) Date: Oct. 30, 1996

[87] PCT Pub. No.: WO94/20804

PCT Pub. Date: Sep. 15, 1994

[30] Foreign Application Priority Data

Mar. 4, 1993 [NO] Norway ..... 930787

[51] Int. Cl.[6] ..... F26B 3/08

[52] U.S. Cl. ..... 34/363; 34/378; 34/407; 34/408; 34/171; 34/172

[58] Field of Search ..... 34/363, 377, 378, 34/407, 408, 172, 177

[56] References Cited

U.S. PATENT DOCUMENTS 4,602,438 7/1986 Draper et al. ..... 34/363

*Primary Examiner*—Henry Bennett
*Assistant Examiner*—Pamela A. Wilson
*Attorney, Agent, or Firm*—Dennison, Meserole, Pollack & Scheiner

[57] ABSTRACT

A method and apparatus for drying of a material containing a volatile component, in which the material is disposed in a bed in a drying zone which is in communication with a closed circuit in which a gaseous drying medium is circulated. Associated with the drying gone is a closed heat pump system including a compressor, at least one condenser in the drying zone, a super heat exchanger and a working medium. The drying zone is supplied with super heat from the super heat exchanger, and the condenser is supplied with working medium from a super heat exchanger, thereby increasing the temperature in the drying zone.

13 Claims, 2 Drawing Sheets

METHOD AND APPARATUS FOR DRYING OF MATERIALS CONTAINING VOLATILE COMPONENTS

BACKGROUND OF THE INVENTION

The invention concerns a method and apparatus for drying of solid materials, such as granular products alone, or in combination with fluids.

DESCRIPTION OF RELATED ART

Drying of certain granules, such as in the food industry and feed industry, places great demands on the drying process in order to obtain the best attainable product quality with as little product deterioration as possible while at the same time maintaining the product's physical, chemical, visual and nutritional properties.

Known methods are substantially based on drying with warm air, in which the drying air, after use, is vented to the atmosphere with consequential energy loss. An improvement of this simple drying principle resulted in closed drying plants in which charges of mass to be dryed are located in a drying room connected with a closed loop for circulating drying air, optionally in combination with a heat pump.

U.S. Pat. No. 4,335,150 describes a drying process, in which humid material is passed over an absorption material.

None of these prior art principles have provided satisfactorily results, either because of reduced quality of excessive process costs.

NO Patent No. 164,331 describes a method and an apparatus for drying an/or freezing of granules in which the granules are located in a zone which is swept with a gaseous drying medium and, optionally, a refrigerant, thus keeping the granule mass in motion. The drying medium moves in a closed circuit provided with a heat pump.

The drawback of the latter method is that the drying in the drying chamber 10A occurs adiabatically. As a result the gaseous drying medium, during its passage through the drying mass, is cooled because of the evaporating humidity. The ability of the drying medium to accommodate humidity thus decreases continuously during the flow through the mass. In spite of the presence of a heat pump and circulation of drying medium, this principle involves for example unnecessary high operating costs and cap costs, since it requires circulation of relatively large volumes of drying medium in order to maintain acceptable drying capacity.

SUMMARY OF THE INVENTION

The main object of the invention is to provide a method and apparatus that reduces the investment costs as well as operating costs.

According to the present invention, the drying zone, comprising the mass to be dried (hereinafter referred to as "drying mass") and a flowing drying medium, such as air, is supplied with heat to compensate for heat loss resulting from the volatile compound evaporating from the mass. In this way the drying zone is operated according to a substantially isothermal principle thereby increasing the absolute absorption capacity of the drying medium compared with an adiabatic drying process, dependent on the heat supplied.

The term "drying mass" is meant to comprise any material, solid as well as fluid, which can be subjected to drying to remove volatile components. Examples of drying masses in this connection can comprise particles, powder, granules, suspensions, emulsions and solutions. An example of handling of fluids (suspensions and solutions) may constitute distribution of the drying mass on the surface of stationary inert bodies, such as plastic spheres whereby the drying mass establishes a film on the inert body, thus allowing for vaporization of volatile components from a larger area. The inert bodies are stationary in the sense of remaining within the drying chamber during the drying process.

At 80° C., the ability of air to absorb humidity increase about 32 times in an isothermal process compared with an adiabatic process. The drying mass can be present as a fixed bed or as a fluidized bed. The process can be accomplished in batches or performed continuously. In a preferred embodiment, the drying mass moves continuously countercurrently to the drying medium, thus establishing a true continuous process.

The heat can be supplied in the vicinity of the drying mass, or can be supplied between two or more drying stages. The heat supply in connection with the drying zone is accomplished with heat from the high pressure end of a connected heat pump system, e.g. condenser heat and/or super heat, as described in more detail below. In this way the need for energy supply, and the attendant operating costs (in particular the investments costs) are decreased compared with an adiabatic drying process. Compared with another embodiment of known drying processes using a fluidized drying chamber without heat supplied directly into the drying mass, the method of the present invention results in substantial reduction in both operating and investment costs. Moreover, the present invention can result in improved product quality since, contrary to present prior art techniques drying can be accomplished with a product specific temperature across a wide temperature range while at the same time maintaining high drying capacity.

BRIEF DESCRIPTION OF THE DRAWINGS

In the following more detailed description of the present invention reference will be made to the accompanying to drawings, in which.

DESCRIPTION OF THE PREFERRED EMBODIMENTS

Figure 1:
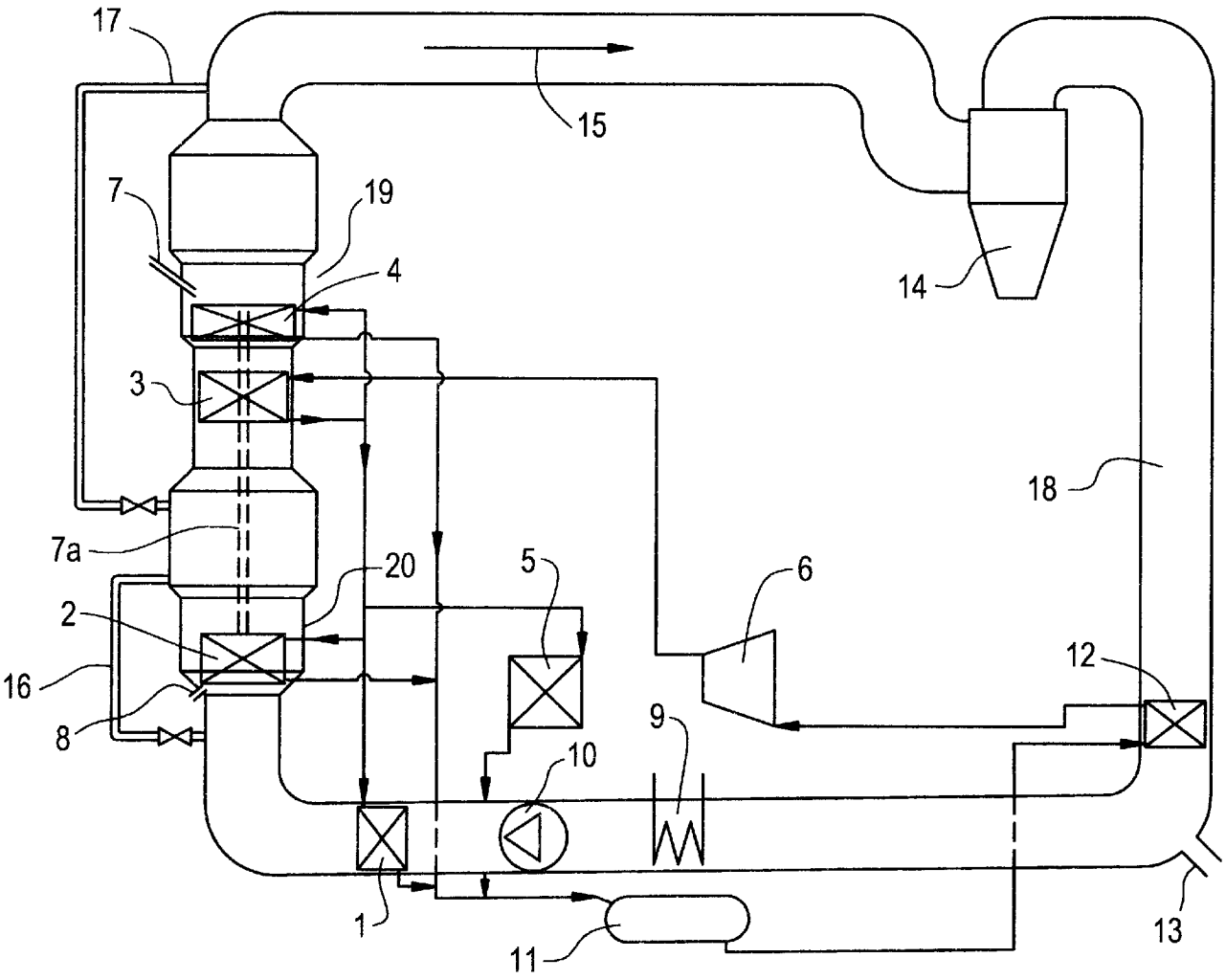
FIG. 1 is a simplified flow sheet showing an embodiment of the present invention.

FIG. 1 shows a schematic flow sheet of a drying process including one embodiment of the present invention. Drying mass (not illustrated) containing volatile components, is supplied continuously to a drying zone via a supply line 7, and is dried in a first drying zone (first with respect to the flow direction of the drying mass), generally indicated at 19. A heat pump condenser 4 is arranged in this drying zone, as described in more detail below. The partly dried drying mass is thereafter conveyed, via a pipe, channel or similar 7*a* arranged within the drying zone, to the second and last drying stage, generally indicated at 20, in connection with a heat pump condenser indicated with reference numeral 2. The completely dried drying mass is withdrawn from the second drying zone 20 in a pipe 8 or similar. The drying medium, e.g. air, circulates in a duct 18 in a direction indicated by arrow 15, which, after humidifying in the drying sections 20 and 19, is separated from dust and smaller particles entrained from the material, in e.g. a cyclone 14. Separated dust particles from the cyclone 14 can, if necessary, be returned back to the first and/or second drying step. The volatile components are condensed using a heat pump condenser 12, whereupon the condensed volatile components are drained from the drying medium circulation loop in a pipe 13 or similar.

The drying medium is circulated in the duct 18 by a fan or similar 10 and prior to contact with the drying mass is pre-heated to the desired drying temperature by means of a heat pump condenser 1 located within the duct 18 upstream of the second drying zone 20. In the second section of the drying zone 20, the drying medium contacts partly dried drying mass. Heat loss caused by evaporating volatile components is compensated by supply of heat to the drying medium from the heat pump condenser 2, thus causing the drying in said step to occur substantially isothermally. The heat pump condenser 2 located within the second drying zone 20 is supplied with gaseous working medium from the pressurized end of a compressor 6 in a heat pump system after removal of super heat in a heat exchanger 3 located between the drying zones 19 and 20.

The drying medium, which at this stage is partly saturated with volatile components from the drying mass, flows further and is heated to a temperature above the condensing temperature by means of the super heat remover 3. The absolute humidity absorption capacity of the drying medium is thus increased prior to entering the next drying chamber. The drying medium then flows to the first drying zone 19 and contacts the heat pump condenser 4 and the in-flowing drying mass, which is preferably fluidized in the drying chamber 19. The condenser 4, supplied with gaseous working medium from the super heat remover 3, supplies heat to the drying medium, thus, at least in part, compensating for heat loss caused by the volatile components evaporating from the drying mass.

Any excess heat present in the system is removed in a condenser 5, whereupon condensate from all condensers are collected in a vessel or similar 11. Condensate from vessel 11 evaporates in the heat pump evaporator 12 and is supplied to the suction end of the compressor 6. A heating element or similar 9 is arranged in the duct 18 to facilitate process startup.

Dried drying mass is withdrawn from the second drying chamber 20 via an outlet fitting 8, and is either passed to e.g. storage vessels or, if necessary, partly recycled (not shown) back to the first drying chamber 19, dependent on the condition of the drying mass and the desired product quality. The embodiment of FIG. 1 is further illustrated with a bypass pipe 17 and 16 for the drying mass, beyond first and second drying chamber 19 and 20, respectively, for the drying mass in consideration of controlling or in case of operating disturbances.

Figure 2:
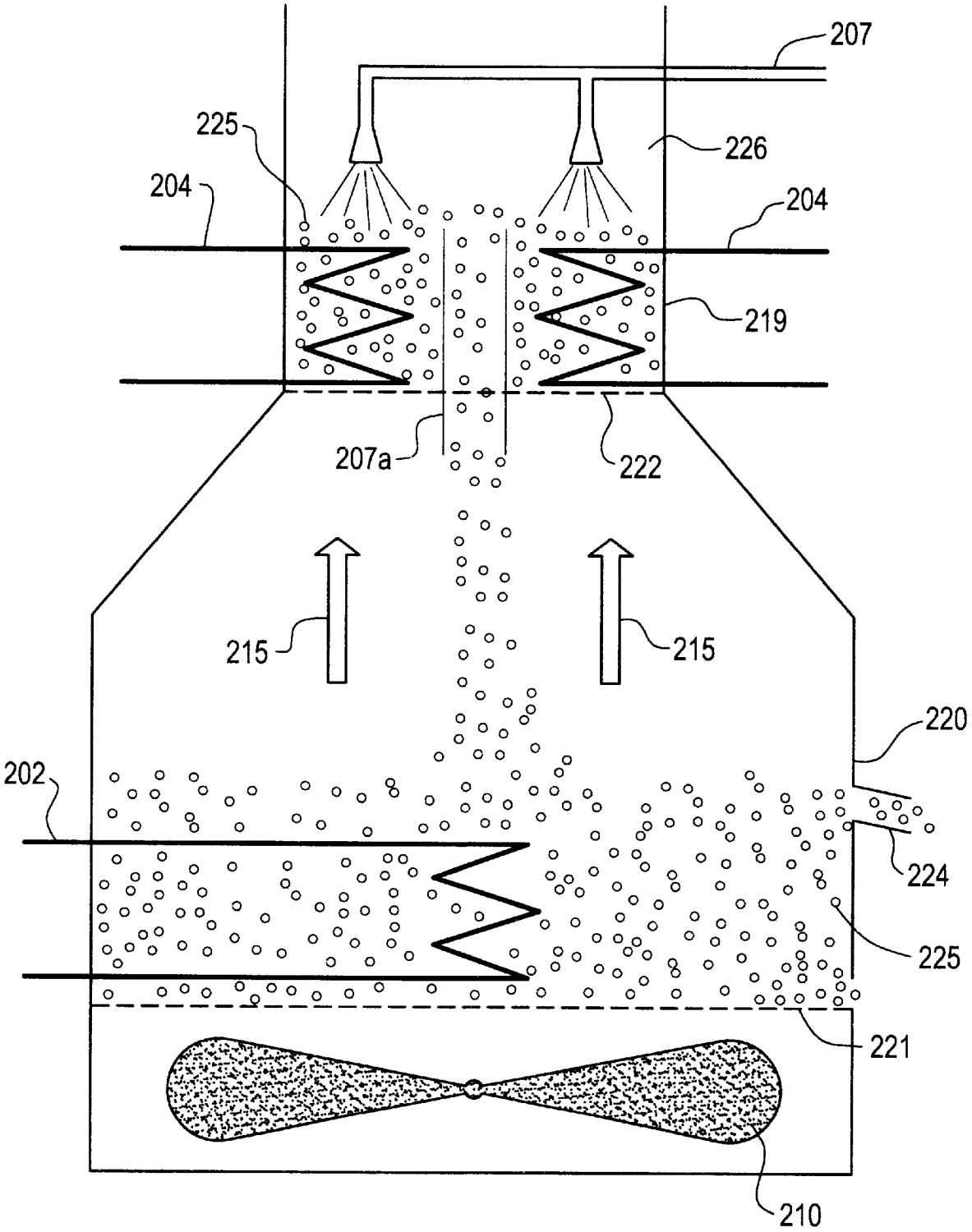
FIG. 2 is a schematic illustration in cross section of an apparatus, in accordance with the present invention.

FIG. 2 is a principle drawing which schematically illustrates an alternative embodiment of a drying chamber according to the present invention which comprises a first drying zone 219 and a second drying zone 220. The drying mass 225, e.g. granules, are supplied to the first drying zone 219 form a pipe 207 and is dispersed within the drying chamber by dispersion means 226, i.e. nozzles in case of fluid drying masses 225. The drying mass 225 is kept within the chamber by a perforated grid/plate 22 which allows for the through flow of drying medium. The first drying zone 219 communicates with the second drying zone 220 by means of an overflow pipe 207*a* arranged substantially perpendicular to, and through, the grid 222. The upper part of the overflow pipe 207*a* extends into first chamber 219 a distance above the grid. In this way, the particles having lowest weight, and accordingly the dryest ones, are allowed to fall down into the second drying chamber counter—currently with the drying medium, which flow direction is indicated by arrows 215. A heat pump condenser 204 is arranged in the first drying zone 219, and serves as a super heat remover and/or condenser for the heat pump working medium, e.g. ammonia, from the high pressure end of a compressor in an integrated heat pump plant.

The partly dried drying mass 225 in FIG. 2 falls down into the second drying chamber 220, which is supplied with heat from a second parallel heat pump condenser 202 arranged within the drying chamber. The heat pump condenser 202 is preferably formed as a shell and tube heat exchanger. In this embodiment, the drying mass is kept fluidized by the upward flowing drying medium. A perforated grid 221 prevents the drying mass from falling down into the drying section. The dried drying mass 225 leaves the second drying chamber 220 via an outlet pipe 224, or similar, and is passed to product vessels or partly recycled back to the first drying chamber (not illustrated). The outlet pipe 224 is, in this embodiment, arranged as an overflow pipe, at which the fraction of the drying mass 225 having lowest weight (driest) is allowed to flow out of the second drying chamber 220. A fan 210, which in this embodiment is located in connection with the drying chamber 219, 220 itself, provides for flow of drying medium up through the latter.

The overflow pipe 7*a* and 207*a* illustrated in FIGS. 1 and 2, respectively, for partly dried drying mass is arranged centrally within the drying chamber with the upper end of said overflow pipe extending a distance above the grid (222 in FIG. 2) to establish an overflow for partly dried drying mass. However, transfer of partly dried drying mass from one chamber to another can also be accomplished by an externally arranged connection, such as a down pipe optionally provided with a worm conveyor or similar. Moreover, the condensers in at least one of the drying chambers can be formed as a coil exchanger to establish a plug-flow of drying mass through the condenser/heat exchanger. Accordingly, the outlet fitting or transfer fitting for dried or partly dried drying mass, respectively, are arranged as desired in the drying chamber in question, dependent on the type of heat exchanger/condenser.

Dependent on the condition of the drying mass or product demands, the drying section may be provided with one or more drying chamber. Each drying chamber is provided with one or more different parallel heat pump condensers with, or without, heating of the drying mass between different drying sections by means on super heat remover(s) of a connected heat pump system. In a single-stage process, the condensers 1, 3 and 4 illustrated in FIG. 1 can for example be operated as one integral heat pump condenser and optionally combined super heat remover. In this way the absolute humidity absorption capacity of the drying medium can be further increased.

By using a fixed bed the drying sections can be oriented at any angle, but when using a fluidized bed the main axis of each drying chamber must be oriented substantially vertically, i.e. the drying medium must flow substantially vertically in an upwards direction through the drying mass in a separate drying chamber. Different drying chambers can, however, be located in a horizontal arrangement if for example the total dimensions of the complete drying section are to be considered.

EXAMPLE

This design example is intended to illustrate the cost saving position for an isothermal process according to the present invention compared with a conventional isentalpic process.

Starting with the absorption isotherm for fish meal, a calculation is made for an ideal process for the drying of 3.6 tons fish meal per hour by using air with humidity absorption from a relative humidity (RH) of 30% to RH 90% according to the present invention (cf. FIG. 1) and from RH 30% at 70° C. for a conventional adiabatic process. The fish meal is to be dried to a final moisture content of 8 wt. %, at which the rate of humidity removal is calculated to be 5.9 tons per hour. The air speed is calculated to be 3 m/s and the pressure loss in the air recycle circuit is determined to be 200 mm water through the entire system for an adiabatic process and to be 400 mm water for an isothermal process according to the present invention. The energy costs are calculated on the basis of an energy cost of NOK 0.35 per kWh.

Table 1 below shows an extract of the calculations with a few key parameters with regard to investment and operation.

TABLE 1

| | Isentalpic process | Isothermal process |
|---|---|---|
| Drying chamber area | 64 $m^2$ | 3.5 $m^2$ |
| Volume of circulated air | 192 $m^3$ | 10.5 $m^3$ |
| Compressor size | 2488 $m^3/h$ | 2000 $m^3/h$ |
| Energy consumption (total) | 2274 kW | 1440 kW |
| Relative area requirement | 3 | 1 |
| Energy costs per kg meal | NOK 0.22 | NOK 0.14 |
| Heat pump investment | NOK 8.1 mill | NOK 7.1 mill |
| Air system investment | NOK 8.0 mill | NOK 1.0 mill. |
| Total investments | NOK 16.1 mill | NOK 8.1 mill |

As appers from Table 1 above, a substantially isothermal process according to the invention provides substantial savings with regard to invenstment as well as operating costs. As the process according to the present invention can be operated at substantially isothermal conditions, at least for some of the different drying stages, the volume of circulating drying medium can be reduced significantly. As appears from Table 1 above, particularly a significant reduction of required drying chamber area and circulated volume of drying medium is particularly achievable, which again result in a reduced need for heating/cooling of drying medium including transport of drying medium.

What is claimed is:

1. Method for batch or continuous drying of a material containing a volatile component, comprising the steps of:

disposing said material in a bed in a drying zone comprising at least one drying stage;

placing said drying zone in communication with a substantially closed circuit in which a gaseous drying medium is circulated, providing a closed heat pump system in association with the drying zone, the heat pump system comprising a compressor, at least one condenser disposed in the drying zone, a super heat exchanger and a working medium, supplying the drying zone with super heat from said super heat exchanger, and supplying said condenser with working medium from the super heat exchanger, thereby increasing the temperature in the drying zone.

2. Method in accordance with claim 1, wherein the drying zone comprises first and second drying stages with said super heat exchanger disposed between the first and second drying stages, said super heat exchanger supplying working medium to a condenser disposed in the first drying stage and a condenser disposed in the second drying stage.

3. Method in accordance with claim 1, additionally comprising pre-heating the drying medium with condenser heat from the heat pump system by means of a further condenser arranged to receive working medium in parallel with said condenser.

4. Method in accordance with claim 1, wherein the material flows from an inlet to an outlet, and the gaseous drying medium flows countercurrently to the material.

5. Method in accordance with claim 1, wherein the bed is a fixed bed.

6. Method in accordance with claim 1, wherein the bed is a fluidized bed.

7. Apparatus for batch or continuous drying of a material containing a volatile component, said apparatus comprising:

at least one drying chamber for accommodating the material in a bed;

a duct for circulating a gaseous drying medium through said at least one drying chamber in a substantially closed circuit by a circulating means; and a closed heat pump system including a condenser arranged in said circuit downstream of the drying chamber to condense volatile components in the drying medium, at least one further condenser disposed in said drying chamber to supply heat for drying the material and a compressor, and at least one super heat exchanger arranged in communication with said at least one drying chamber to heat the drying medium by means of super heated working medium supplied under pressure from the compressor, said at least one further condenser being arranged downstream of the super heat exchanger in the heat pump system to receive working medium from the super heat exchanger.

8. Apparatus in accordance with claim 7, wherein the drying chamber comprises a first chamber having a condenser and a second chamber having a condenser, and said super heat exchanger is arranged between said first and second chambers, the first chamber condenser and the second chamber condenser being connected in parallel for receiving working medium from the super heat exchanger.

9. Apparatus in accordance with claim 7, wherein said first drying chamber comprises a drying chamber and allowing for through flow of drying medium, and a transport pipe for transferring partly dried material to said second chamber, said second chamber being provided with an outlet means for dried material.

10. Apparatus in accordance with claim 9, wherein an additional condenser is arranged in said duct immediately upstream of the second drying chamber to pre-heat said drying medium prior to contacting the material, said additional condenser being arranged in parallel with the first and second chamber condensers for receiving working medium from the compressor.

11. Apparatus in accordance with claim 7, additionally comprising a particle separator arranged in the duct downstream of the drying chamber for removal of entrained particles from the drying medium.

12. Apparatus in accordance with claim 7, wherein the bed is a fixed bed.

13. Apparatus in accordance with claim 7, wherein the bed is a fluidized bed.

* * * * *